US011383246B2

(12) United States Patent
Eckert et al.

(10) Patent No.: US 11,383,246 B2
(45) Date of Patent: Jul. 12, 2022

(54) METHOD FOR THE LOAD-DEPENDENT OPERATION OF A MATERIAL COMMINUTION SYSTEM

(71) Applicant: Kleemann GmbH, Göppingen (DE)

(72) Inventors: Thorsten Eckert, Börtlingen (DE); Tobias Freihalter, Böhmenkirch (DE); Jochen Meier, Hülben (DE)

(73) Assignee: Kleemann GmbH

( * ) Notice: Subject to any disclaimer, the term of this patent is extended or adjusted under 35 U.S.C. 154(b) by 194 days.

(21) Appl. No.: 16/648,717

(22) PCT Filed: Oct. 8, 2018

(86) PCT No.: PCT/EP2018/077241
§ 371 (c)(1),
(2) Date: Mar. 19, 2020

(87) PCT Pub. No.: WO2019/081186
PCT Pub. Date: May 2, 2019

(65) Prior Publication Data

US 2020/0246804 A1 Aug. 6, 2020

(30) Foreign Application Priority Data

Oct. 25, 2017 (DE) ..... 10 2017 124 958.3

(51) Int. Cl.
*B02C 25/00* (2006.01)
*B02C 1/02* (2006.01)
(Continued)

(52) U.S. Cl.
CPC ..... *B02C 25/00* (2013.01); *B02C 1/02* (2013.01); *B02C 2/042* (2013.01); *B02C 2/047* (2013.01); *B02C 23/02* (2013.01); *B02C 23/08* (2013.01)

(58) Field of Classification Search
CPC .. B02C 25/00; B02C 1/02; B02C 1/00; B02C 1/025; B02C 1/06
See application file for complete search history.

(56) References Cited

U.S. PATENT DOCUMENTS 3,480,212 A 11/1969 Liljegren et al.
4,004,739 A * 1/1977 Cramer ..... B02C 25/00 241/34
(Continued)

FOREIGN PATENT DOCUMENTS

DE 1164216 B 2/1964
DE 1809339 A1 5/1970
(Continued)

OTHER PUBLICATIONS

China Office Action for corresponding patent application No. 20180066752.4, dated Apr. 6, 2021, 6 pages (not prior art).
(Continued)

*Primary Examiner* — Faye Francis
(74) *Attorney, Agent, or Firm* — Lucian Wayne Beavers; Gary L. Montle; Patterson Intellectual Property Law, PC

(57) ABSTRACT

The invention relates to a method for controlling the charging of a crusher, driven by a crusher drive via transmission elements, of a material comminution system, wherein material which is to be crushed is fed to the crusher, a filling level of the crusher is determined using a filling level sensor, and the volume flow of material to be crushed is set and/or regulated according to the filling level determined. The mechanical loading of the crusher or a characteristic variable which is dependent on the mechanical loading of the crusher is determined directly or indirectly, and the filling level of the crusher is set according to the mechanical loading determined, or the characteristic variable which is dependent thereon. The method permits low-wear operation of the
(Continued)

Figure 1:
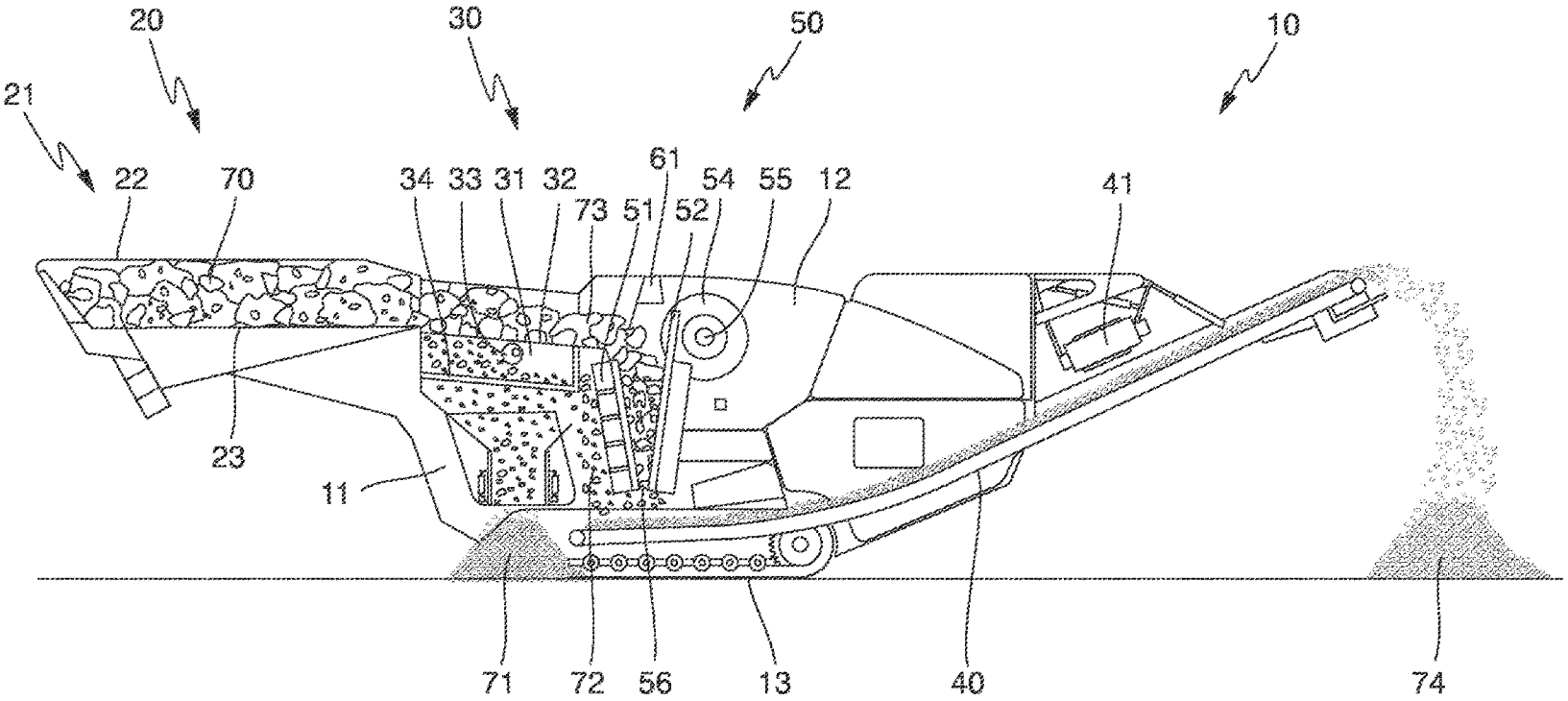

material comminution system and of the crusher with, at the same time, a high material throughput rate.

19 Claims, 3 Drawing Sheets

(51) Int. Cl.

| | |
|---|---|
| *B02C 2/04* | (2006.01) |
| *B02C 23/02* | (2006.01) |
| *B02C 23/08* | (2006.01) |

(56) References Cited

U.S. PATENT DOCUMENTS

| | | | | |
|---|---|---|---|---|
| 4,804,148 | A | 2/1989 | Etheridge | |
| 4,909,449 | A | 3/1990 | Etheridge | |
| 6,619,574 | B1 * | 9/2003 | Fontanille | B02C 17/1805 241/171 |
| 7,942,358 | B2 | 5/2011 | Posti et al. | |
| 8,540,176 | B2 * | 9/2013 | Wallin | B02C 25/00 241/30 |
| 8,960,577 | B2 * | 2/2015 | Tjell | B02C 2/042 241/30 |
| 9,073,056 | B2 | 7/2015 | Abeln | |
| 9,084,998 | B2 * | 7/2015 | Belotserkovskiy | B02C 2/047 |
| 9,199,244 | B2 * | 12/2015 | Belotserkovskiy | B02C 2/04 |
| 10,159,985 | B2 * | 12/2018 | Braun | B02C 25/00 |
| 10,357,777 | B2 * | 7/2019 | Shumka | G01B 11/14 |
| 10,744,513 | B2 * | 8/2020 | Kuvaja | B02C 2/047 |
| 11,020,748 | B2 * | 6/2021 | Tagawa | B02C 25/00 |
| 11,027,287 | B2 * | 6/2021 | Jacobson | B02C 2/08 |
| 2009/0095827 | A1 | 4/2009 | Posti et al. | |
| 2010/0181397 | A1 * | 7/2010 | Wallin | B02C 23/02 241/30 |
| 2014/0103150 | A1 * | 4/2014 | Belotserkovskiy | B02C 25/00 241/27 |
| 2014/0166791 | A1 * | 6/2014 | Tjell | B02C 25/00 241/30 |
| 2014/0306041 | A1 * | 10/2014 | Belotserkovskiy | B02C 2/047 241/30 |
| 2016/0250642 | A1 * | 9/2016 | Lindstrom | B02C 25/00 241/25 |

FOREIGN PATENT DOCUMENTS

| | | | |
|---|---|---|---|
| WO | 2007051890 | A1 | 5/2007 |
| WO | 2008153464 | A1 | 12/2008 |
| WO | 2016095958 | A1 | 6/2016 |

OTHER PUBLICATIONS

India Office Action for corresponding patent application No. 202047017039, dated May 27, 2021, 5 pages (not prior art).

International Search Report and Written Opinion for corresponding PCT/EP2018/077241, dated Jan. 9, 2019, 13 pages (not prior art).

* cited by examiner

METHOD FOR THE LOAD-DEPENDENT OPERATION OF A MATERIAL COMMINUTION SYSTEM

The invention relates to a method for controlling the charging of a crusher, driven by a crusher drive via transmission elements, of a material comminution system, wherein material which is to be crushed, in particular stone material which is to be crushed, is fed to the crusher, wherein a filling level of the crusher, preferably at a crusher inlet, is determined using a filling level sensor and wherein the volume flow of material to be crushed which is fed to the crusher is set and/or controlled according to the determined filling level.

The invention further relates to a control unit for operating such a material comminution system.

The invention further relates to a computer program product for carrying out the method.

Material comminution systems of the aforementioned type are used for comminuting stone material, for example natural stone, concrete, brick or recycling material. The material to be comminuted is supplied to a feed unit of the material comminution system, for example in the form of a hopper, and is supplied to a crusher via transport devices, for example a vibrating feed channel or a belt conveyor. A prescreen unit may be arranged upstream of the crusher in order to conduct fine content or medium grain, which already has the appropriate grain size, past the crusher. The crusher itself may be configured as a jaw crusher, as an impact crusher or as a cone crusher. In the case of a jaw crusher, two crushing jaws which are arranged obliquely to one another form a wedge-shaped shaft into which the material to be comminuted is introduced. Whilst one crushing jaw is fixedly arranged, the opposing crushing jaw may be moved by means of an eccentric. This results in an elliptical movement sequence of the mobile crushing jaw, whereby the crushed material is crushed and guided downwardly in the shaft to a crushing gap. The gap width of the crushing gap, and thus the grain size of the comminuted material which is discharged through the crushing gap from the wedge-shaped shaft, may be set by a gap setting device. The filling level of the material introduced into the shaft and to be comminuted may be measured by means of a filling level sensor which is configured, for example, as an ultrasonic sensor. The volume flow of the material supplied via the transport device to the crusher may be set by corresponding activation of the transport device according to the determined filling level.

During the crushing process the crusher is subjected to high mechanical loadings. These loadings are due, amongst other things, to the feed size, the grain distribution and the crushing strength of the supplied material and the desired comminution ratio and the filling level of the material to be crushed inside the crushing chamber of the crusher. In the case of faulty operation of the material comminution system, in particular with a grain feed size which is too large and a comminution ratio which is too high, it may lead to an overloading of the crusher. As a result, the various components of the crusher, the crusher drive or the transmission elements which are subjected to high loads may be damaged or become worn too rapidly.

A method and a crusher which identify a bridging of the crusher are disclosed in WO 2016/162598. In the crusher configured as a cone crusher, a shaft of the cone is rotatably held in an axial bearing. The axial bearing is mounted on arms leading radially from the outer walls of the cone crusher as a support. A bridging of the crusher may occur when material becomes jammed between the cone and an arm and, as a result, the cone is lifted up which may lead to damage to the crusher. In order to identify such a bridging relative to an arm of the support, the loading of the support is determined and evaluated. To this end, the pressure in a hydraulic cylinder of a hydraulic actuator for the vertical adjustment of the cone may be measured. During the evaluation the power consumption of a drive of the crusher may also be considered. Also described is the possibility of measuring and evaluating mechanical stresses introduced into the arms of the support, for example by means of strain gages. In this case, the measurement may be carried out directly on the arms but also on adjacent components which are connected to the arms. If a bridging of the crusher has been identified it is proposed to reduce or to interrupt the charging of the crusher.

It is the object of the invention to provide a method which reliably avoids an overloading of a crusher of a material comminution system. It is also the object of the invention to provide a control device and a computer program product for carrying out such a method.

The object of the invention relating to the method is achieved by the mechanical loading of the crusher or a characteristic variable which is dependent on the mechanical loading of the crusher being determined directly or indirectly and by the filling level of the crusher being set according to the determined mechanical loading or the characteristic variable which is dependent thereon. Different material properties, such as different feed sizes, grain distributions, crushing strengths and different comminution ratios, with a given filling level result in different loadings of the crusher. According to the invention, the mechanical loading of the crusher or a characteristic variable which is dependent on the mechanical loading of the crusher is determined. According to the mechanical loading of the crusher, a filling level of the crusher is predetermined in which, with a material throughput rate which is as high as possible, an overloading of the crusher is reliably avoided. This is preferably carried out by controlling the components which supply the material, for example a vibrating feed channel, according to the filling level of the crusher measured by means of the filling level sensor.

A reliable determination of the present mechanical loading of the crusher may be achieved by the mechanical loading and/or the movement behavior of at least one component of the crusher, the transmission elements and/or the crusher drive being measured as a characteristic variable which is dependent on the mechanical loading of the crusher and/or an operating state of the crusher drive being measured as a characteristic variable which is dependent on the mechanical loading of the crusher. In this case, the measurement of the mechanical loading of the at least one component is preferably carried out on a component of the crusher, the transmission elements or the crusher drive which is subjected to high mechanical loads. If by setting the filling level according to the invention it is ensured that the component which is subjected to high mechanical loads is not overloaded, it may be assumed therefrom that the remaining components of the crusher are also moved within their permissible loading range. All of the components which are provided for transmitting torque and/or power from the crusher drive to the crusher are understood as transmission elements within the meaning of the present invention.

Corresponding to a particularly preferred variant of the invention, it may be provided that for determining the mechanical loading of the at least one component of the crusher, the transmission elements and/or the crusher drive, the strain of the at least one component is determined and that the filling level of the crusher is set according to the determined strain of the component or a variable derived therefrom. The strain of the at least one component is directly dependent on the mechanical loading of the component and thus on the mechanical loading of the crusher. By the monitoring thereof, the filling level of the crusher may be set such that an overloading of the crusher is reliably avoided.

A measurement of the strain of the at least one component which is simple and reliable may be achieved by the strain being determined by at least one sensor, for example a strain gage. Advantageously, the at least one strain gage may be fastened in a simple manner to the component to be monitored.

Advantageously, it may be provided that the mechanical stress of the at least one component of the crusher, the transmission elements or the crusher drive is determined from the strain and that the filling level of the crusher is set according to the mechanical stress of the at least one component of the crusher, the transmission elements or the crusher drive. The determined mechanical stress may be compared with permissible stresses of the material used. The filling level of the crusher may then be set such that the permissible stresses of the material of the component used, advantageously by taking into account a safety factor, are not exceeded.

According to one possible variant, it may be provided that for determining the movement behavior of the at least one component of the crusher, the transmission elements and/or the crusher drive, an acceleration is preferably determined by an acceleration sensor and/or a rotational speed and/or a rotational speed alteration is preferably determined by a rotational speed sensor. The movement behavior in the drive train alters with an alteration of the loading of the crusher. In this case it may be an ongoing alteration of the movement behavior, for example a rotational speed, or a temporary alteration, for example when due to an alteration of the movement behavior the power of the crusher drive is re-adjusted and a predetermined reference rotational speed is reset. It is possible to obtain information about the loading of the crusher from an alteration of the movement behavior of the at least one component of the crusher, the transmission elements and/or the crusher drive, which is caused by an alteration of the loading of the crusher.

Generally it is provided to operate the crusher drive at a rated speed which may be set. When the loading of the crusher is altered, the rated speed is controlled by a corresponding adaptation of the power of the crusher drive. The power to be applied by the crusher drive and the operating parameters associated therewith are thus dependent on the current loading of the crusher. If the power of the crusher drive is not re-adjusted in the case of an alteration of the loading of the crusher, this leads to an alteration of the rotational speed of the crusher drive. Thus it may be provided that the operating state of the crusher drive is determined by a power output and/or by a torque and/or by an energy consumption and/or by a fuel consumption and/or by a rotational speed of the crusher drive. These variables are directly associated with the load to be applied by the crusher and thus the mechanical loading of the crusher, so that when they are known a suitable filling level of the crusher may be set.

An overloading of the crusher may be avoided by the filling level of the crusher being reduced when the mechanical loading of the crusher or a characteristic variable which is directly dependent on the mechanical loading of the crusher exceeds a predetermined upper limit value or when a characteristic variable which is inversely dependent on the mechanical loading of the crusher falls below a predetermined lower threshold value and/or by the filling level of the crusher being reduced when the mechanical loading of the crusher or a characteristic variable which is directly dependent on the mechanical loading of the crusher within a predetermined first time period $\Delta t_1$ has exceeded the predetermined upper limit value with a predetermined frequency or over a predetermined duration or when a characteristic variable which is inversely dependent on the mechanical loading of the crusher within the predetermined first time period $\Delta t_1$ has fallen below the predetermined lower threshold value with a predetermined frequency or over a predetermined duration. The limit value and/or the threshold value establishes when the permissible loading of the crusher is exceeded. If the filling level of the crusher is already reduced when the limit value is first exceeded and/or the threshold value is first fallen below, a rapid reaction may be achieved relative to the crusher being subjected to loads which are too high. If the limit value within the predetermined first time period $\Delta t_1$ has to be exceeded repeatedly or cumulatively over a predetermined duration, in order to achieve a reduction in the filling level, the prediction reliability of the evaluation of the loading of the crusher may be increased. The same applies when the characteristic variable which is inversely dependent on the mechanical loading of the crusher falls below the threshold value. The prediction of a frequency of exceeding the limit value and/or falling below the threshold value is, in particular, advantageous in the case of jaw crushers since they are subjected to a cyclical loading by the cyclical opening and closing of the movable crushing jaw.

A high throughput rate of the crusher may be achieved by the filling level of the crusher being increased when the mechanical loading of the crusher or a characteristic variable which is directly dependent on the mechanical loading of the crusher does not exceed a predetermined lower limit value over a predetermined second time period $\Delta t_2$ or when a characteristic variable which is inversely dependent on the mechanical loading of the crusher does not fall below a predetermined upper threshold value over the predetermined second time period $\Delta t_2$ and/or by the filling level of the crusher being increased when the mechanical loading of the crusher or a characteristic variable which is directly dependent on the mechanical loading of the crusher exceeds the predetermined lower limit value over the predetermined second time period $\Delta t_2$ no more than with a predetermined second frequency or longer than a predetermined duration or when a characteristic variable which is inversely dependent on the mechanical loading of the crusher falls below the predetermined upper threshold value over the predetermined second time period no more than with a predetermined second frequency or longer than a predetermined duration. When the limit value is fallen below and/or the threshold value is exceeded over a lengthy period of time, a low mechanical loading of the crusher may be established. By increasing the filling level the throughput rate of the crusher may be increased without it being overloaded. This permits an economical operation of the crusher and/or the material comminution system.

If it is provided that after reducing and/or increasing the filling level of the crusher no further determination and/or evaluation of the mechanical loading of the crusher or the characteristic variable which is dependent on the mechanical loading of the crusher and/or no further setting of the filling level of the crusher is carried out until a predetermined waiting time $\Delta t_{blind1}$, $\Delta t_{blind2}$ has elapsed, after an alteration of the filling level has been initiated, sufficient time remains for the newly predetermined filling level to be set. A fluctuation in the control circuit may thus be avoided.

Advantageously, it may be provided that in each case the filling level of the crusher is reduced and/or increased by a predetermined absolute value or in each case the filling level of the crusher is reduced and/or increased by a value relative to the actual filling level. The alteration of the filling level by absolute values is able to be implemented in a simple manner. In this case, advantageously the alteration of the filling level is equal during a reduction and during an increase, so that specific filling levels which are optimized for specific functions may be repeatedly set. When alterations are carried out relative to the present filling level, different alterations may be made to the filling level, for example it is possible that, starting from large filling levels, large alterations of the filling level may be undertaken and, starting from small filling levels, small alterations of the filling level may be undertaken. Naturally, applications are also conceivable in which the reverse procedure is carried out. This permits an accurate setting of the filling level, in particular with large comminution ratios (small gap width of the crushing gap) which cause the crusher to be subjected to high loading and thus require a relatively low filling level. The comminution ratio describes the ratio of the grain size of the feed material at 80% screen throughput to the grain size of the end product at 80% screen throughput. Thus a high throughput rate of the crusher and/or the material comminution system is achieved, even with large comminution grades of the crusher.

A simple evaluation of the loading of the crusher which may be implemented, for example, in a simple manner in a computer program, may be achieved by loading categories, which in each case are assigned to a low loading, a desired loading or an excessive loading of the crusher, being established, such that successive specific mechanical loadings of the crusher or successive specific values of the characteristic variable which is dependent on the mechanical loading of the crusher are assigned in each case to a loading category. The setting of the filling level may be carried out according to the loading category to which the determined loadings and/or parameters have been assigned.

In this case, it may be provided that the filling level of the crusher is reduced when over a predetermined first time span a predetermined number of determined loadings of the crusher or values of the characteristic variable which is dependent on the loading are assigned to a loading category which is assigned to an excessive loading, that the filling level of the crusher is increased when over a predetermined second timespan a predetermined number of determined loadings or values of the characteristic variable which is dependent on the loading are assigned to a loading category which is assigned to a low loading, and that the filling level is not altered when the determined loadings or the values of the parameter which is dependent on the loading are assigned to a loading category which is assigned to a desired loading. The filling level of the crusher is set according to the assignment of the determined loading of the crusher or the characteristic variable which is dependent thereon to the respective loading categories.

Crushers are generally subjected to a cyclical loading, wherein maximum loadings occur, repeated periodically. These maximum loadings which occur should not exceed the maximum loading of the crusher, at least not over a long period of time. Thus it may be provided that when the loading of the crusher changes periodically, the maximum values of the loading of the crusher or the values of the parameter, which is dependent on the loading of the crusher, assigned to the maximum values are determined and the filling level of the crusher is set according to the maximum values of the loading of the crusher or the values of the parameter, which is dependent on the loading of the crusher, assigned to the maximum values.

The object of the invention relating to the control device is achieved by a control device for operating a material comminution system comprising a crusher, wherein the control device is configured for carrying out at least the following steps:

- detecting and storing a mechanical loading of the crusher or a characteristic variable which is dependent on the mechanical loading of the crusher,
- setting the filling level of the crusher according to the detected mechanical loading or the characteristic variable which is dependent thereon.

Thus the control device enables the above-described method to be carried out.

The object of the invention is further achieved by a computer program product which may be directly loaded into the internal memory of a digital computer and which comprises software code segments by which the steps as claimed in one of claims 1-14 are executed when the product runs on a computer.

The object of the invention is also achieved by a computer program product which is stored in a medium which may be inserted into a computer, comprising computer-readable program means by which a computer may execute the method as claimed in one of claims 1-14.

The computer program products may be implemented in a simple manner in a control unit of the material comminution system. The computer program products may advantageously utilize measurement signals of an already present filling level sensor which is connected to the control unit. Moreover, the computer program products may act on control systems which are already present and by which the components supplying material are controlled according to the signal of the filling level sensor. Thus the method may be cost-effectively integrated in existing material comminution systems by simply adding the software.

Figure 2:
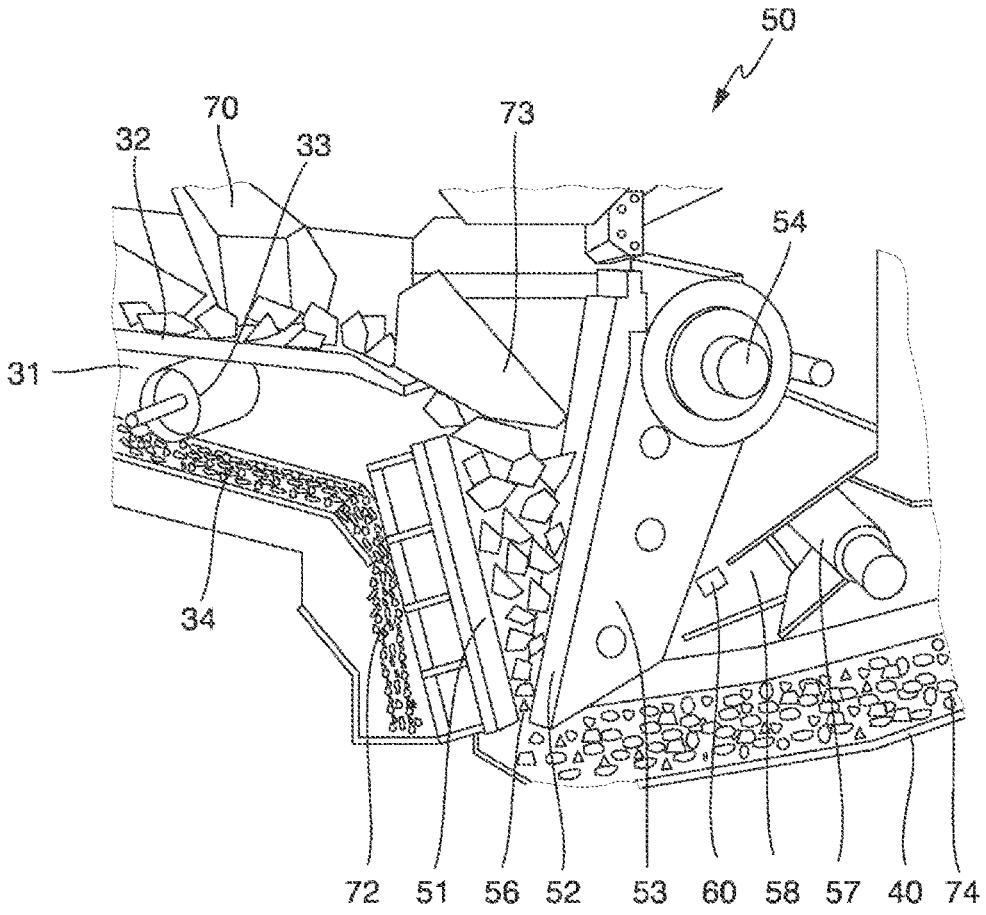
Figure 3:
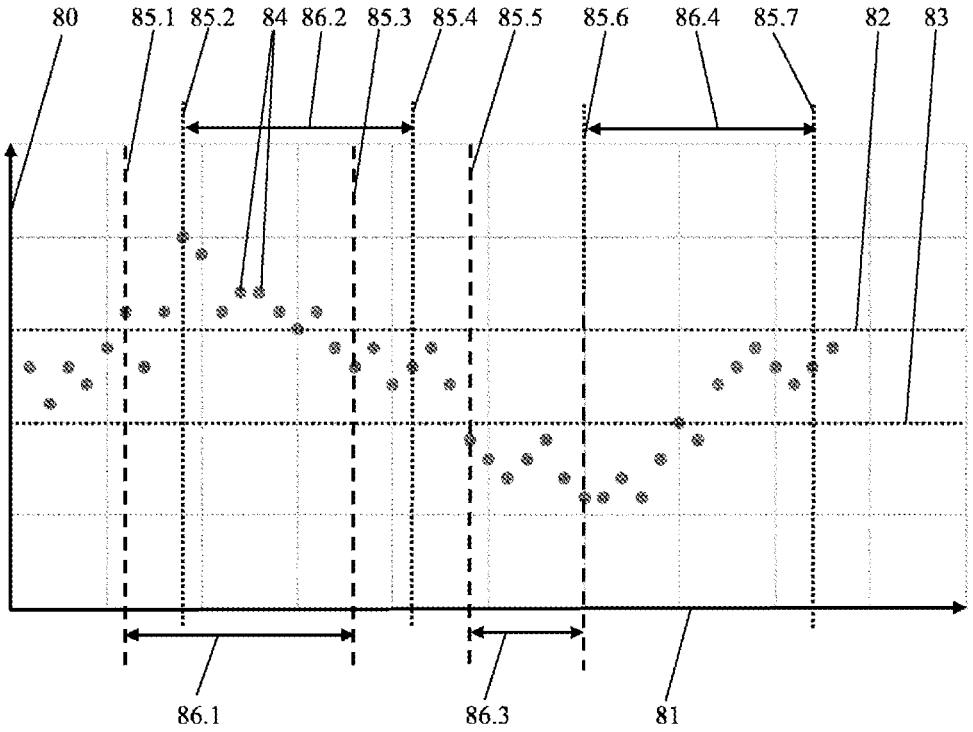
Figure 4:
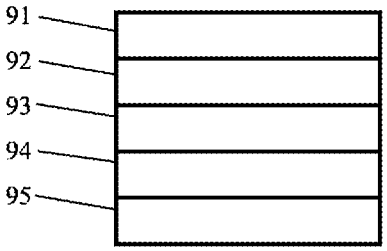

The invention is described in more detail hereinafter with reference to an exemplary embodiment shown in the drawings. In the drawings:

FIG. 1 shows in a lateral, partially sectional view a material comminution system comprising a crusher, FIG. 2 shows in an enlarged perspective view the crusher shown in FIG. 1, FIG. 3 shows measured values applied in a stress-time diagram for the mechanical stress of a component of the crusher shown in FIGS. 1 and 2 and FIG. 4 shows in a simplified view a screen output of different loading categories.

FIG. 1 shows in a lateral, partially sectional view a material comminution system 10 comprising a crusher 50. The material comminution system 10 may be configured as a mobile system with a chassis 11 and a chain drive 13. The material comminution system has a feed unit 20, if required a prescreen unit 30, the crusher 50 and at least one crusher discharge belt 40.

A hopper 21 may be arranged in the region of the feed unit 20. The hopper 21 has hopper walls 22. The hopper deflects the supplied feed material 70 onto a vibrating feed channel 23.

The vibrating feed channel 23 conveys the feed material 70 to a double-deck prescreen 31 of the prescreen unit 30. The double-deck heavy-piece screen 31 has an upper deck 32 configured as a relatively coarse screen and a lower deck 34 configured as a relatively fine screen. The double-deck heavy-piece screen is set in circular vibration by a drive 33. The upper deck 32 separates the fine content 71 and the medium grain 72 from the material 73 to be crushed. The lower deck 34 separates the fine content 71 from the medium grain 72. The fine content 71 may optionally be conducted out of the material comminution system 10 or supplied to the medium grain 72 by a corresponding position of a bypass flap. The medium grain 72 is guided past the crusher 50 via a bypass to the crusher discharge belt 40. The material 73 to be crushed is supplied at the end of the prescreen unit 30 to the crusher 50 via a crusher inlet.

The crusher 50 is configured as a jaw crusher. However, it is also conceivable to provide other crushers 50, for example impact crushers or cone crushers. The crusher 50 has a fixed crushing jaw 51 and a mobile crushing jaw 52. These crushing jaws are oriented so as to run obliquely to one another so that a shaft which tapers conically toward a crushing gap 56 is configured therebetween. The mobile crushing jaw 52 is driven by an eccentric 54. The eccentric 54 may be connected via a drive shaft 55 to a drive unit 12 of the material comminution system 10. The drive unit 12 serves as a crusher drive. It may also be used as a drive for the conveying devices and the chain drive and optionally further mobile components of the material comminution system 10. By means of the eccentric 54 the mobile crushing jaw 52 is moved in an elliptical movement toward the fixed crushing jaw 51 and away therefrom. During such a stroke, the spacing also alters between the crushing jaws 51, 52 in the region of the crushing gap 56. By the movement of the mobile crushing jaw 52, the material to be crushed 73 is increasingly comminuted along the conical shaft until it has reached a grain size which permits it to leave the shaft through the crushing gap 56. The comminuted material 74 drops onto the crusher discharge belt 40 and is transported away thereby. In this case, for example, it may also be provided that it is conducted past a magnetic separator 41, which separates metal magnetic components from the comminuted material 74, and is ejected to the side.

A filling level sensor 61 is assigned to the crusher 50. The filling level sensor 61 is shown schematically in FIG. 1. In the present case it is configured as an ultrasonic sensor. However, it is also conceivable to use other types of sensor, for example optical sensors (for example a camera system) or mechanically acting sensors. The filling level sensor 61 monitors the filling level of the crusher 50 with material 73 to be crushed. It is part of a continuous control of the charging of the material comminution system 10. To this end, the components of the material comminution system 10 supplying the material, in particular the vibrating feed channel 23 and/or the double-deck prescreen 31, are activated according to the signals of the filling level sensor 61, and thus the volume flow of the material 73 which is to be crushed and which is supplied to the crusher 50 is controlled.

FIG. 2 shows in an enlarged perspective view the crusher 50 shown in FIG. 1. It is possible to identify clearly the shaft of the crusher 50 running conically toward the crushing gap 56 between the two crushing jaws 51, 52, to which the material to be crushed 73 is supplied via the prescreen unit 30. The mobile crushing jaw 52 is driven via the eccentric 54. To this end the mobile crushing jaw 52 is fastened to a movably mounted swing jaw 53, the eccentric 54 acting thereon. The swing jaw 53 may be supported by a pressure plate 58 in the direction of the crushing gap 56. The pressure plate 58 is connected to a gap setting device 57 opposite the swing jaw 53. By means of the gap setting device 57 the width of the crushing gap 56 and thus the grain size of the comminuted material 74 may be set. The filling level sensor 60 shown schematically in FIG. 1 is not shown in FIG. 2 but is provided for monitoring the filling level.

The pressure plate 58 is a component of the crusher 50. During the operation of the crusher 50 the pressure plate is subjected to high mechanical loadings. These loadings are representative of the loading of the crusher 50 as a whole. In this case the loading of the crusher 50 and thus that of the pressure plate 58 alters cyclically with the movement of the mobile crushing jaw 52. The maximum loadings occur during a working stroke in which the mobile crushing jaw 52 moves toward the fixed jaw 51. These maximum loadings lead to the greatest wear of the components of the crusher 50. If the maximum loadings are too great, this may lead to damage of the crusher 50, the crusher drive or the transmission elements (for example the eccentric 54).

In order to detect the loading of the crusher 50, for example, a strain gage 60 may be fastened to the pressure plate 58 or another force transmitting component connected to the pressure plate 58. The strain gage 60 measures the strain of the pressure plate 58 or a force transmitting component. The strain gage is a measurement of the mechanical loading of the pressure plate 58. It is thus also a measurement of the mechanical loading of the crusher 50. The strain of the pressure plate 58 represents a characteristic variable which is dependent on the mechanical loading of the crusher 50. According to the invention, the filling level of the crusher 50 is set according to the specific mechanical loading of the crusher 50 or a characteristic variable which is dependent thereon. This is carried out by corresponding activation of one or more of the components supplying the crusher 50 with material to be crushed 73, according to the filling level determined by the filling level sensor 61.

FIG. 3 shows measured values applied to a stress-time diagram for the mechanical stress of a component of the crusher 50 shown in FIGS. 1 and 2. In practice, maximum stress values 84, as occur in successive strokes of the crusher 50 which is configured as a jaw crusher, are applied relative to a stress axis 80 and a time axis 81. For improved clarity and illustration, the maximum stress values are shown with a very low frequency. In practice, clearly more working strokes may be executed for each time unit and evaluated according to the following description. The maximum stress values 84 are measured in the present case by means of the strain gage 60 on the pressure plate 58 shown in FIG. 2. An upper limit value 82 and a lower limit value 83 for the stresses are identified as horizontal dotted lines. During the first five strokes, the determined maximum stress values 84 are in the desired range between the upper and lower limit values 82, 83. With the sixth stroke the measured maximum stress value 84 exceeds the upper limit value 82. When the maximum stress value 84 is first exceeded, a first time period $\Delta t_1$ 86.1 begins to run. The first time period $\Delta t_1$ 86.1 is, for example, two minutes. It starts at a first time point $t_1$ 85.1 and ends at a third time point $t_3$ 85.3. If within the first time period $\Delta t_1$ 86.1 a predetermined number of maximum stress values 84 exceeds the upper limit value 82, an overloading of the crusher 50 is assumed. In the exemplary embodiment shown, an overloading of the crusher 50 is assumed when within the first time period $\Delta t_1$ 86.1 three maximum stress values 84 exceed the upper limit value 82. In the present case this takes place at a second time point $t_2$ 85.2. From this second time point $t_2$ 85.2 the filling level of the crusher 50 is reduced. At the same time, a first waiting time period $\Delta t_{blind1}$ 86.2 starts. Within the first waiting time period $\Delta t_{blind1}$ 86.2 the determined maximum stress values 84 are not evaluated and/or no further adaptation of the filling level is undertaken. This provides sufficient time to set the filling level of the crusher 50 according to the new specifications. In the present case, the first waiting time period $\Delta t_{blind1}$ 86.2 is two minutes. It ends at a fourth time point $t_4$ 85.4. After the first waiting time period $\Delta t_{blind1}$ 86.2 the maximum stress values 84 are detected and evaluated again. If these values are between the two limit values 82, 83, no further correction of the filling level is carried out. If the maximum stress values 84 fall below the lower limit value 83 as is shown by way of example at a fifth time point $t_5$ 85.5, a second time period $\Delta t_2$ 86.3 starts to run. In the present case the second time period $\Delta t_2$ 86.3 lasts one minute. It thus ends at a sixth time period $t_6$ 85.6. If, as in the exemplary embodiment shown, within the second time period $\Delta t_2$ 86.3 the measured maximum stress values 84 are below the lower limit value 83, after the second time period $\Delta t_2$ 86.3 has elapsed, i.e. at the sixth time period $t_6$ 85.6, the filling level of the crusher 50 is increased. A waiting time also starts (second waiting time period $\Delta t_{blind2}$ 86.4) with the alteration of the filling level. In the present case the second waiting time period $\Delta t_{blind2}$ 86.4 is two minutes and thus corresponds to the first waiting time period $\Delta t_{blind1}$ 86.2. It ends at a seventh time point $t_7$ 85.7. Preferably, the durations of the waiting time periods $\Delta t_{blind1/2}$ 86.2, 86.4 are equal. Within the second waiting time period $\Delta t_{blind2}$ 86.4 the maximum stress values 84 are not measured and/or not evaluated and/or no adaptation to the filling level is carried out. The second waiting time period $\Delta t_{blind2}$ 86.4 thus provides sufficient time for the new filling level of the crusher 50 to be set. After the second waiting time period $\Delta t_{blind2}$ 86.4 has elapsed, the monitoring of the maximum stress values 84 is carried out again.

By the monitoring shown in FIG. 3 of the maximum stress values 84 and the respective setting of the filling level of the crusher 50 when the respective limit values 82, 83 are exceeded or fallen below, in the present case the maximum stresses of the pressure plate 58 as a component of the crusher 50 are therefore controlled in a predetermined range. By the correlation of the current loading of the pressure plate 58 with that of the entire crusher 50, the loading of the crusher may therefore be kept in a permissible range. As a result, an overloading of the crusher 50, the crusher drive and the transmission elements is avoided. At the same time a maximum throughput rate of the crusher 50, which is possible without overloading the crusher 50, is achieved.

FIG. 4 shows in a simplified view a screen output of different loading categories 91, 92, 93, 94, 95. The loading categories 91, 92, 93, 94, 95 in each case correspond to loading ranges of the crusher 50 or a component of the crusher 50, the crusher drive or the transmission elements. A first loading category 91 comprises loadings which are present in the idle state of the crusher 50. A second loading category 92 corresponds to a low loading range of the crusher and a third loading category 93 corresponds to a slightly higher loading range of the crusher 50. A fourth loading category 94 comprises a desired loading range of the crusher 50. In this range it is possible to eliminate damage to the crusher 50 or excessive wear of the crusher 50 by overloading. At the same time, a high throughput rate of the crusher 50 is achieved. Transferred to the diagram shown in FIG. 3, the fourth loading category 94 is in the range between the upper and the lower limit value 82, 83. A fifth loading category 95 comprises a loading range which leads to an overloading of the crusher 50, the crusher drive or the transmission elements.

The measured loading or the assigned characteristic variable of the crusher 50, a component of the crusher, the crusher drive or the transmission element, are assigned to a respective loading category 91, 92, 93, 94, 95. If within a specified timespan (first time period $\Delta t_1$ 86.1 see FIG. 3) the measured loadings of the crusher 50 and/or the values of the characteristic variable associated therewith of a predetermined number of strokes are assigned to the fifth loading category 95, the filling level of the crusher 50 is reduced. Then a time window of a predetermined duration elapses in which no determination and/or evaluation is carried out of the loading of the crusher 50 or the characteristic variable which is dependent thereon and/or no further adaptation is made to the filling level. During this time window of, for example, two minutes, the filling level of the crusher 50 reduces. If the measured loadings of the crusher 50 and/or the values of the characteristic variable associated therewith have been assigned to the fourth loading category 94, no alteration is made to the filling level. If the measured loadings of the crusher 50 or the values of the characteristic variable associated therewith are, for a predetermined second timespan (second time period $\Delta t_2$, 86.3 in FIG. 2), in the range of the second and third loading category 92, 93, the filling level of the crusher 50 is increased. The assignment of the measured loadings to the loading categories 91, 92, 93, 94, 95 permits a simple implementation of the method by corresponding software. This software may be implemented, for example, in a control unit of the material comminution system 10.

According to the view in FIGS. 1-4, therefore, the loading of the crusher 50 or a characteristic variable associated therewith is determined. Particularly preferably, the strain of a component of the crusher 50, the transmission elements or the crusher drive subjected to high loads is detected, said strain occurring as a result of a force generally introduced periodically into the structure. However, other characteristic variables characterizing the loading of the crusher 50 may also be used for the evaluation, for example the loading or the movement behavior of a component of the crusher 50, the crusher drive or the transmission elements, between the crusher drive and the crusher 50.

The strain may be determined in a simple manner by at least one strain gage 60. This strain gage is preferably fastened to a component of the crusher, the crusher drive or the transmission elements subjected to particularly high mechanical loads. Mechanical stresses may be calculated from the strain measured by means of the strain gage 60. These may be compared with the permissible stresses of the material used. The stress values measured with each periodically occurring load may be assigned to the loading categories 91, 92, 93, 94, 95. When the permissible continuous loading of the material comminution system 10 and/or the crusher 50 is exceeded over a previously fixed time period, the filling level of the crusher 50 is automatically adapted until the loading is again in a predetermined permissible range. The control is preferably carried out in this case by means of correspondingly configured software. This effects the control of the components supplying the material, according to the specific loading of the crusher 50 and the signal of the filling level sensor 61. The control is carried out such that a maximum volume flow of material to be crushed 73 is always supplied to the crusher 50 without said crusher being overloaded.

Different material properties such as feed size, grain distribution, crushing strength, comminution index and different comminution ratios result in different filling levels within the acceptable loading range. The method identifies the resulting loading, irrespective of these factors and sets the filling level of the crusher 50 such that the loading of the crusher 50 settles into a desired normal range. This is carried out by the corresponding activation of the components supplying the material.

In the exemplary embodiment shown in FIG. 2 the strain gage 60 is fastened to the pressure plate 58. However, it is also conceivable to arrange the strain gage 60 on a different component of the material comminution system 10 which is subjected to high load. Thus the strain gage 60 may be fastened, for example, to the swing jaw 53 or to parts of the eccentric 54. It is also conceivable to provide other methods, for example optical methods, for determining the strain and thus the stress of the monitored component.

It is also conceivable for evaluating the loading of the crusher to determine the movement behavior of at least one component of the crusher 50, the transmission elements and/or the crusher drive. Thus, for example, an ongoing or corrected and thus temporary alteration of the rotational speed of the crusher drive may indicate an altered loading of the crusher 50. The operating parameters of the crusher drive (torque, power, fuel consumption, etc.) are also directly dependent on the loading of the crusher 50 and may be correspondingly evaluated.

The invention claimed is:

1. A method for controlling the charging of a crusher, driven by a crusher drive via transmission elements, of a material comminution system wherein material which is to be crushed is fed to the crusher, the method comprising:

measuring an actual filling level of the crusher at a crusher inlet using a filling level sensor;

determining a mechanical loading of the crusher or a characteristic variable which is dependent on the mechanical loading of the crusher;

automatically setting the filling level of the crusher according to the determined mechanical loading or the characteristic variable which is dependent thereon; and controlling a volume flow to the crusher of the material to be crushed according to the measured actual filling level and the set filling level of the crusher.

2. The method of claim 1, wherein a movement behavior of at least one component of one or more of the crusher, the transmission elements, and the crusher drive is measured as a characteristic variable which is dependent on the mechanical loading of the crusher.

3. The method of claim 2, wherein the movement behavior of the at least one component of the one or more of the crusher, the transmission elements, and the crusher drive is determined via one or more of:

an acceleration sensor configured to determine an acceleration; and a rotational speed sensor configured to determine one or more of a rotational speed and a rotational speed alteration.

4. The method of claim 1, wherein a mechanical loading of at least one component of one or more of the crusher, the transmission elements, and the crusher drive is measured as a characteristic variable which is dependent on the mechanical loading of the crusher.

5. The method of claim 4, wherein for measuring the mechanical loading of the at least one component of one or more of the crusher, the transmission elements, and the crusher drive, the strain of the at least one component is determined via at least one strain gage.

6. The method of claim 5, wherein:

a mechanical stress of the at least one component of the one or more of the crusher, the transmission elements, and the crusher drive is determined from the strain, and the filling level of the crusher is set according to the mechanical stress of the at least one component of the one or more of the crusher, the transmission elements, and the crusher drive.

7. The method of claim 1, wherein an operating state of the crusher drive is measured as a characteristic variable which is dependent on the mechanical loading of the crusher.

8. The method of claim 7, wherein the operating state of the crusher drive is determined by measuring one or more of a power output, a torque, an energy consumption, a fuel consumption, and a rotational speed of the crusher drive.

9. The method of claim 1, further comprising reducing the filling level of the crusher upon one or more of:

the mechanical loading of the crusher or a characteristic variable which is dependent on the mechanical loading of the crusher exceeding a predetermined upper limit value;

a characteristic variable which is inversely dependent on the mechanical loading of the crusher falling below a predetermined lower threshold value;

the mechanical loading of the crusher or a characteristic variable which is directly dependent on the mechanical loading of the crusher within a predetermined first time period exceeding the predetermined upper limit value with a predetermined frequency or over a predetermined duration; and a characteristic variable which is inversely dependent on the mechanical loading of the crusher within the predetermined first time period having fallen below the predetermined lower threshold value with a predetermined frequency or over a predetermined duration.

10. The method of claim 9, wherein after reducing the filling level of the crusher, lapsing of a predetermined waiting time is required before one or more of: further determination and/or evaluation of the mechanical loading of the crusher or the characteristic variable which is dependent on the mechanical loading of the crusher; and further setting of the filling level of the crusher.

11. The method of claim 9, wherein the filling level of the crusher is reduced by a predetermined absolute value or by a value relative to the actual filling level.

12. The method of claim 9, further comprising increasing the filling level of the crusher upon one or more of:

when the mechanical loading of the crusher or a characteristic variable which is directly dependent on the mechanical loading of the crusher does not exceed a predetermined lower limit value over a predetermined second time period;

when a characteristic variable which is inversely dependent on the mechanical loading of the crusher does not fall below a predetermined upper threshold value over the predetermined second time period;

when the mechanical loading of the crusher or a characteristic variable which is directly dependent on the mechanical loading of the crusher exceeds the predetermined lower limit value over the predetermined second time period with no more than a predetermined second frequency or longer than a predetermined duration; and when a characteristic variable which is inversely dependent on the mechanical loading of the crusher falls below the predetermined upper threshold value over the predetermined second time period with no more than a predetermined second frequency or longer than a predetermined duration.

13. The method of claim 12, wherein after increasing the filling level of the crusher, lapsing of a predetermined waiting time is required before one or more of: further determination and/or evaluation of the mechanical loading of the crusher or the characteristic variable which is dependent on the mechanical loading of the crusher; and further setting of the filling level of the crusher.

14. The method of claim 12, wherein the filling level of the crusher is increased by a predetermined absolute value or by a value relative to the actual filling level.

15. The method of claim 1, wherein:

a plurality of loading categories is established, each of the plurality of loading categories assigned to a low loading, a desired loading, or an excessive loading of the crusher, and successive specific mechanical loadings of the crusher or successive specific values of the characteristic variable which is dependent on the mechanical loading of the crusher are assigned in each case to a loading category.

16. The method of claim 15, wherein:

the filling level of the crusher is reduced when over a predetermined first time span a predetermined number of determined loadings of the crusher or values of the characteristic variable which is dependent on the loading are assigned to a loading category which is assigned to an excessive loading, the filling level of the crusher is increased when over a predetermined second time span a predetermined number of determined loadings or values of the characteristic variable which is dependent on the loading are assigned to a loading category which is assigned to a low load, and the filling level is not altered when the determined loadings or the values of the parameter which is dependent on the loading are assigned to a loading category which is assigned to a desired loading.

17. The method of claim 1, further comprising, in association with periodic changes in the loading of the crusher:

determining maximum values of the loading of the crusher or values of the parameter, which is dependent on the loading of the crusher, assigned to the maximum values, and setting the filling level of the crusher according to the maximum values of the loading of the crusher or the values of the parameter, which is dependent on the loading of the crusher, assigned to the maximum values.

18. A material comminution system comprising:

a crusher, driven by a crusher drive via transmission elements, wherein material which is to be crushed is fed thereto;

a filling level sensor configured to measure an actual filling level of the crusher at a crusher inlet; and a control device configured to determine a mechanical loading of the crusher or a characteristic variable which is dependent on the mechanical loading of the crusher;

automatically set the filling level of the crusher according to the determined mechanical loading or the characteristic variable which is dependent thereon; and control a volume flow to the crusher of the material to be crushed according to the measured actual filling level and the set filling level of the crusher.

19. A material comminution system comprising:

a crusher, driven by a crusher drive via transmission elements, wherein material which is to be crushed is fed thereto;

a filling level sensor configured to measure an actual filling level of the crusher at a crusher inlet; and a computer readable medium having software code segments residing thereon, and executable by a computer to direct the performance of operations comprising determining a mechanical loading of the crusher or a characteristic variable which is dependent on the mechanical loading of the crusher;

automatically setting the filling level of the crusher according to the determined mechanical loading or the characteristic variable which is dependent thereon; and controlling a volume flow to the crusher of the material to be crushed according to the measured actual filling level and the set filling level of the crusher.

* * * * *